US006000777A

United States Patent [19]

Nozawa et al.

[11] Patent Number: 6,000,777

[45] **Date of Patent: *Dec. 14, 1999**

[54] INK JET RECORDING HEAD, INK JET RECORDING APPARATUS, AND INFORMATION PROCESSING SYSTEM

[75] Inventors: Minoru Nozawa; Masashi Kitani, both of Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/637,373

[22] Filed: Apr. 25, 1996

[30] Foreign Application Priority Data

Apr. 28, 1995 [JP] Japan ..... 7-106694

[51] Int. Cl.[6] ..... B41J 2/01; B41J 2/05

[52] U.S. Cl. ..... 347/20; 347/63

[58] Field of Search ..... 347/20, 43, 63, 347/65, 42, 40

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,897,674 | 1/1990 | Hirasawa | 346/140 R |
| 4,914,736 | 4/1990 | Matsuda | 347/43 |
| 4,947,191 | 8/1990 | Nozawa et al. | 346/140 R |
| 5,006,867 | 4/1991 | Koizumi et al. | 346/140 R |
| 5,126,768 | 6/1992 | Nozawa et al. | 346/140 R |
| 5,332,466 | 7/1994 | Nozawa | 156/633 |
| 5,499,042 | 3/1996 | Yanagawa | 347/69 |

FOREIGN PATENT DOCUMENTS

| | | |
|---|---|---|
| 54-56847 | 5/1979 | Japan . |
| 55-132253 | 10/1980 | Japan . |
| 59-138461 | 1/1983 | Japan . |
| 59-123670 | 7/1984 | Japan . |

*Primary Examiner*—Benjamin R. Fuller
*Attorney, Agent, or Firm*—Fitzpatrick, Cella, Harper & Scinto

[57] ABSTRACT

An ink jet recording head comprises a ceiling plate provided with a plurality of grooves to form ink paths, a plurality of extrusions confining the grooves, recesses serving as common liquid chambers conductively connected with the grooves, and supply apertures for supplying ink to the common liquid chambers; and an elemental substrate having a plurality of energy generating elements formed on it to generate energy for use of discharging ink. This ink jet recording head is formed by connecting such ceiling plate and elemental substrate, in which the ceiling plate is provided with a plurality of recesses, separation walls to separate adjacent common liquid chambers, and sealing material fill-in grooves formed on the separation walls, while the elemental substrate is provided with sealing material anti-running members for preventing the sealing material from flowing into each of the liquid chambers from the gaps between the separation walls and the elemental substrate, and then, the said sealing material is filled in the sealing material fill-in grooves. With the structure thus arranged, it is possible to fabricate the recording heads in good yield, while easily attaining the separation of common liquid chambers reliably.

15 Claims, 8 Drawing Sheets

INK JET RECORDING HEAD, INK JET RECORDING APPARATUS, AND INFORMATION PROCESSING SYSTEM

BACKGROUND OF THE INVENTION

1. Field of the invention

The present invention relates to a recording apparatus for recording characters, images, and other information on a recording material, and a recording head of an ink jet type mounted on such apparatus used for information processing systems, such as a copying machine, a facsimile equipment, a printer, a word processor, and a personal computer. In this respect, recording includes the provision of ink or the like (such as printing, image formation, print, coloring) with respect to all the ink supporting elements such as cloth, thread, paper, and sheet materials. The present invention is applicable not only to the field of information processing, but also, to the wide industrial fields including the apparel industry, which use cloth, thread, paper, sheet materials, and other ink supporting elements.

2. Related Background Art

It has been in practice that an ink jet recording apparatus for recording on paper, cloth, plastic sheet, OHP sheet, and other recording medium (hereinafter, may also be referred to simply as a recording sheet) is made capable of performing its highly densified recording at high speeds. Therefore, the ink jet recording apparatus is utilized and sold on the market as output means of information processing systems, such as a copying machine, a facsimile equipment, an electronic typewriter, a word processor, or a printer serving as an output terminal of a work station, or a handy or portable printer provided for a personal computer, a host computer, an optical disk device, or a video equipment. In such a case, the ink jet recording apparatus is structured to comply with the function and mode of usage inherent to each of those devices.

In general, an ink jet recording apparatus comprises a carriage having recording means (recording head) and an ink tank mounted on it, conveying means for conveying a recording sheet, and a controlling means for controlling the carriage and sheet conveying means. Then, the recording head that discharges ink droplets from a plurality of discharge ports is caused to serially scan in the direction (main scanning direction) orthogonal to the conveying direction of a recording sheet, while the recording sheet is fed intermittently for an amount equivalent to the recording width of the sheet when recording is at rest. Here, this method is arranged to perform recording by discharging ink onto the recording sheet in accordance with recording signals. Since its running costs are low, this method is used widely. Also, it is used as a quiet recording method. Further, by use of the head having many numbers of nozzles arranged for discharging ink on the straight line in the sub-scanning direction, it is possible to record on the recording sheet by one scanning of the head on the sheet in a width corresponding to such numbers of nozzles at a time. As a result, it is possible to attain the recording operation at a higher speed.

Further, in a case of an ink jet recording apparatus for color recording, color images are formed by superposing ink droplets discharged from the recording heads for use of plural colors. It is generally assumed that when a color recording is performed, three or four kinds of recording heads and ink cartridge are required including the three prime colors, yellow (Y), magenta (M), and cyan (C) or these three colors plus black (B). In recent years, there has been on the practical use an apparatus having these three- or four-color recording heads mounted on it to form images in full color.

Here, in order to make it easier to understand the conventional technique and the present invention, the description will be made of the structural outline of the ink jet recording head generally in use.

The conventional ink jet recording head is structured by putting together the electrothermal transducing elements formed on a silicon substrate, ink discharge ports for use of recording also formed on such silicon substrate, ink paths each having the thermoactive portion in such electrothermal transducing element, and a ceiling plate having a recess to form a common liquid chamber for supplying ink to each of such ink paths as disclosed in Japanese Patent Laid-Open Application No. 55-132253.

FIG. 8 is a sectional perspective view which schematically illustrates the structure of an ink jet recording head.

The recording head 230 is formed by the ceiling 231 and the substrate 232. The ceiling plate 231 is provided with a plurality of grooves 233 that form nozzles serving as ink paths, a large grooved portion 234 serving as the common liquid chamber conductively connected with these grooves, and a supply inlet aperture 235 for supplying ink to such common liquid chamber. Also, the substrate 232 is integrally formed with electrothermal transducing elements 236 each corresponding to the respective nozzle, and each of the electrodes 237 to supply electric power to the respective electrothermal transducing element by the application of film formation technology. Such ceiling plate 231 and substrate 232 are connected to form a plurality of discharge ports (orifices) 238 for discharging ink.

Also, in the ink jet recording head structured as described above, drivers are incorporated to drive the electrothermal transducing elements arranged on the substrate.

Further, in the case of an ink jet recording head for use of color recording, ink jet recording heads each for use of different color are arranged in parallel as an ink jet unit as shown in FIG. 9.

However, when the conventional ink jet recording head as described above, particularly the one for color recording, is used, the space occupied by the recording head becomes larger by several times the space occupied by the head for use of monochromatic recording, because a plurality of recording heads, each for different color, are arranged in parallel. As a result, it is difficult to comply with the users's request that a color printer should be made smaller at lower costs, among others. As a countermeasure, therefore, a proposal is made to the effect that a plurality of common liquid chambers are provided by use of the ceiling plate, hence supplying ink of different color to each of the common liquid chambers thus arranged for performing color recording by use of one recording head. In this case, when a plurality of common liquid chambers are arranged in one and the same recording head, the structure should be arranged in order to separate the common liquid chambers from each other assuredly. For that matter, Therefore, use of sealing material is attempted when separating the plural common chambers. In order words, grooves (separation grooves) are formed on each portion that part one common liquid chamber from another in order to fill in the sealing material. When the ceiling plate and the substrate are connected together, the sealing material is filled in each of such grooves. In this case, the separation grooves are formed along each of the ink paths from the respective common liquid chamber to the ink discharge nozzle. Therefore, it is necessary to prevent the sealing material from flowing into each of the ink paths. For example, if the amount of sealing material to be filled in is too much, there is a fear that the sealing material overflows to block the ink paths. Also, if the filling amount of the sealing material is too small, the separation of the common liquid chambers becomes imperfect. Thus, there is a fear that ink in each of the common liquid chambers is mixed. To prevent ink from being mixed, there is a need for careful considerations that should be given in detail as to the filling amount and filling speed of the sealing material. However, should the sealing material be filled with such care, it invites significant increase of operating time manufacturing costs inevitably.

SUMMARY OF THE INVENTION

The present invention is designed with a view to solving the problems described above. It is an object of the invention to provide an ink jet recording head capable of being manufactured in good yield with an easier attainment of the separation of common liquid chambers, and to provide an ink jet recording apparatus having such recording head mounted on it, as well as information processing systems having such apparatus as its output means.

In order to achieve the object described above, the ink jet recording head of the present invention is provided with a ceiling plate having a plurality of grooves to form ink paths, a plurality of extrusions confining such grooves, recesses serving as common liquid chambers conductively connected with the grooves, and supply apertures for supplying ink to the common liquid chambers formed on it; and an elemental substrate having a plurality of energy generating elements formed on it to generate energy for use of discharging ink. This ink jet recording head is formed by connecting such ceiling plate and such elemental substrate, wherein such ceiling plate is provided with a plurality of recesses, separation walls to separate adjacent common liquid chambers, and grooves formed on the separation walls for filling in sealing material, and the elemental substrate is provided with the sealing material antirunning members in order to prevent such material from flowing into each of the liquid chambers from the gaps between the separation walls and the elemental substrate. Further, the recording head is characterized in that the sealing material is filled in such sealing material fill-in grooves.

In accordance with the present invention, a recording head should preferably be arranged in such a manner that the sealing material antirunning members are higher than the gaps between the ceiling plate and the separation walls to be formed when the ceiling plate and a plurality of substrates are connected.

Also, preferably, the sealing material antirunning members are arranged along the grooves that become the common liquid chambers and the grooves that become the nozzles conductively connected with the common liquid chambers.

Preferably, the sealing resin fill-in grooves are arranged along the grooves that become the common liquid chambers and the grooves that become the nozzles conductively connected with the common liquid chambers, and also, the sealing resin fill-in grooves are provided with dummy nozzles adjacent to the nozzles described above.

Preferably, the dummy nozzles are arranged at the same intervals and in the same height as the aforesaid nozzles.

Further, preferably, fluid resistive members are arranged in the locations on the downstream side of the ink paths in the nozzles and with respect to the energy transducing elements.

Preferably, the fluid resistive members are formed by the same material as that of the sealing material antirunning members.

Preferably, the sealing material antirunning members are formed by elastic material.

Preferably, the aforesaid recording head is for use of color recording, and also, each of the plural common liquid chambers is for use of ink of different color.

Preferably, the aforesaid recording head is a recording head of a full line type.

Preferably, the energy transducing elements are electrothermal transducing element for creating film boiling in ink.

Also, the ink jet recording apparatus of the present invention is characterized in that the apparatus is arranged to mount such ink jet recording head as means for recording images.

Further, the information processing systems of the present invention are characterized in that such systems are arranged to adopt the aforesaid ink jet recording apparatus as its output means.

With the structures described above, it is possible to prevent the sealing material from flowing into the ink paths or common liquid chambers when the sealing material is filled into the sealing material fill-in grooves, because there are put together the ceiling plate provided with the separation walls for separating the adjacent common liquid chambers and the sealing material fill-in grooves formed on the separation walls, and the substrate provided with the sealing material antirunning members planted to stand for nipping the separation walls, while being in close contact with them.

BRIEF DESCRIPTION OF THE DRAWINGS

FIG. 4A is a cross-sectional view showing the connecting portion between the ceiling plate and substrate; and FIG. 4B is a perspective view showing the substrate.

FIG. 6A is a cross-sectional view showing the connecting portion between the ceiling plate and substrate; FIG. 6B is a perspective view showing the substrate.

DETAILED DESCRIPTION OF THE PREFERRED EMBODIMENTS

Hereinafter, with reference to the accompanying drawings, the description will be made of one preferable embodiment in accordance with the present invention.

(First Embodiment)

Figure 1:
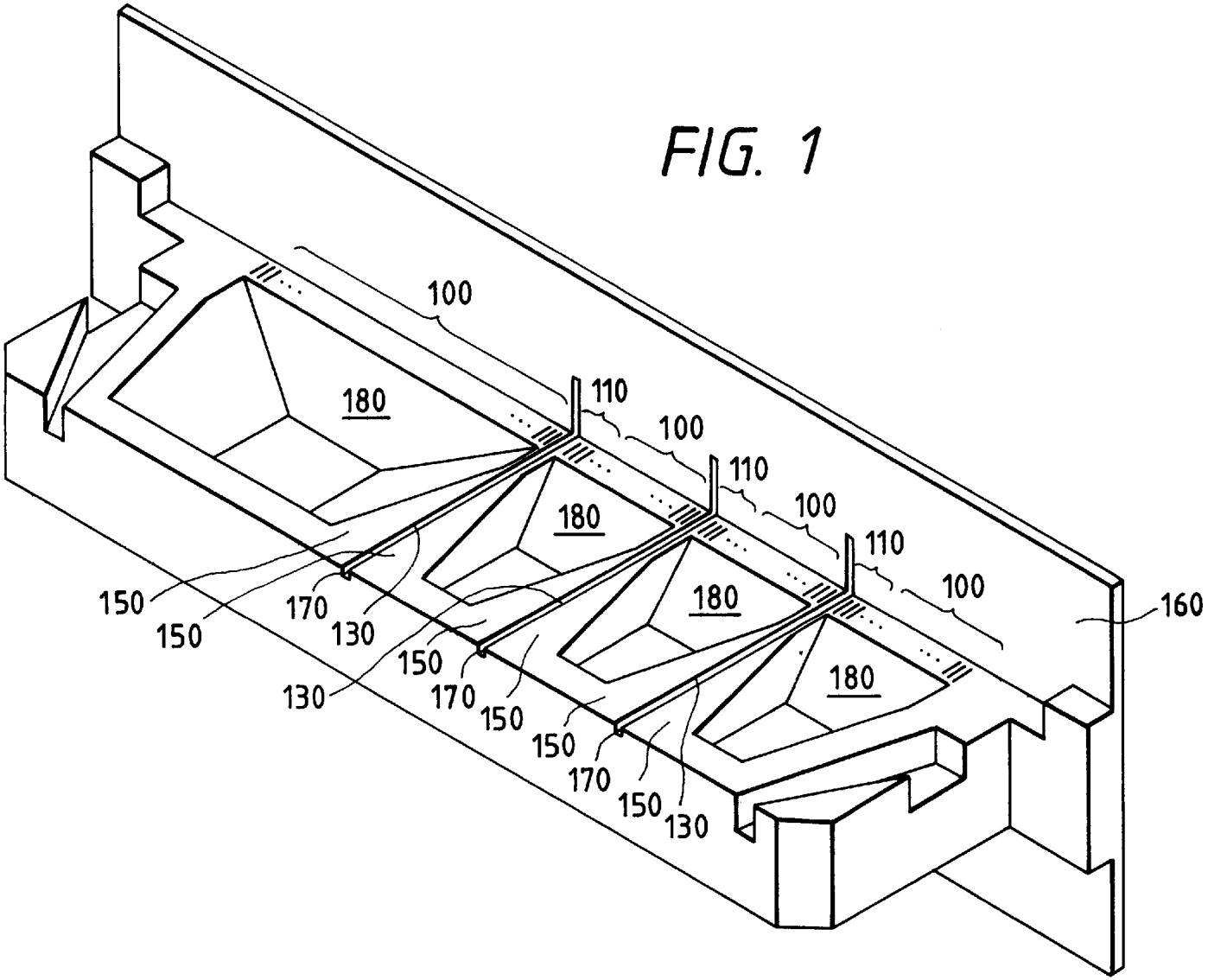
FIG. 1 is a perspective view which illustrates the structure of a ceiling plate applicable to an ink jet recording head in accordance with the present invention.
Figure 2:
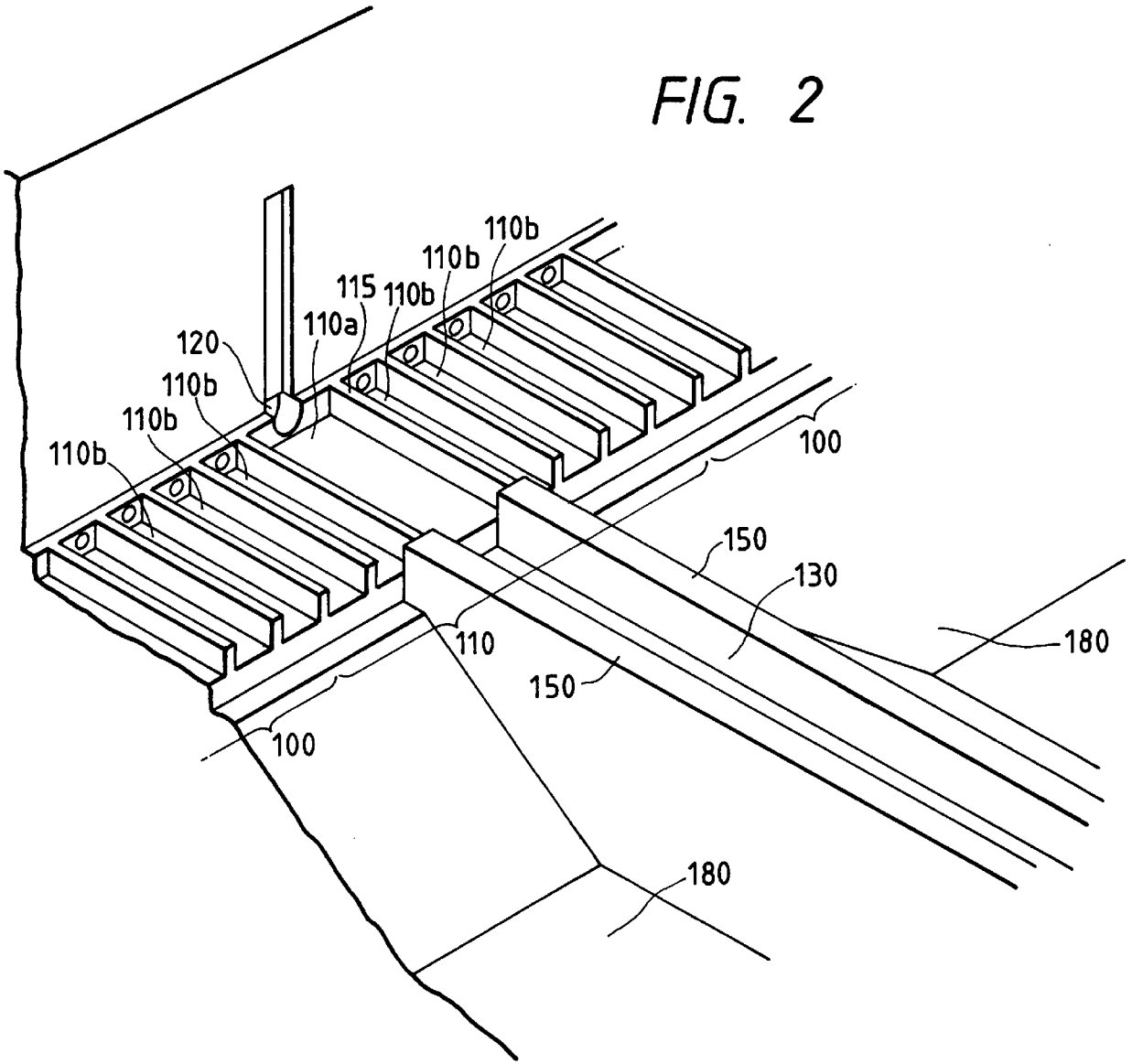
FIG. 2 is an enlargement which shows the nozzle portion and its vicinity on the ceiling plate represented in FIG. 1.
Figure 3:
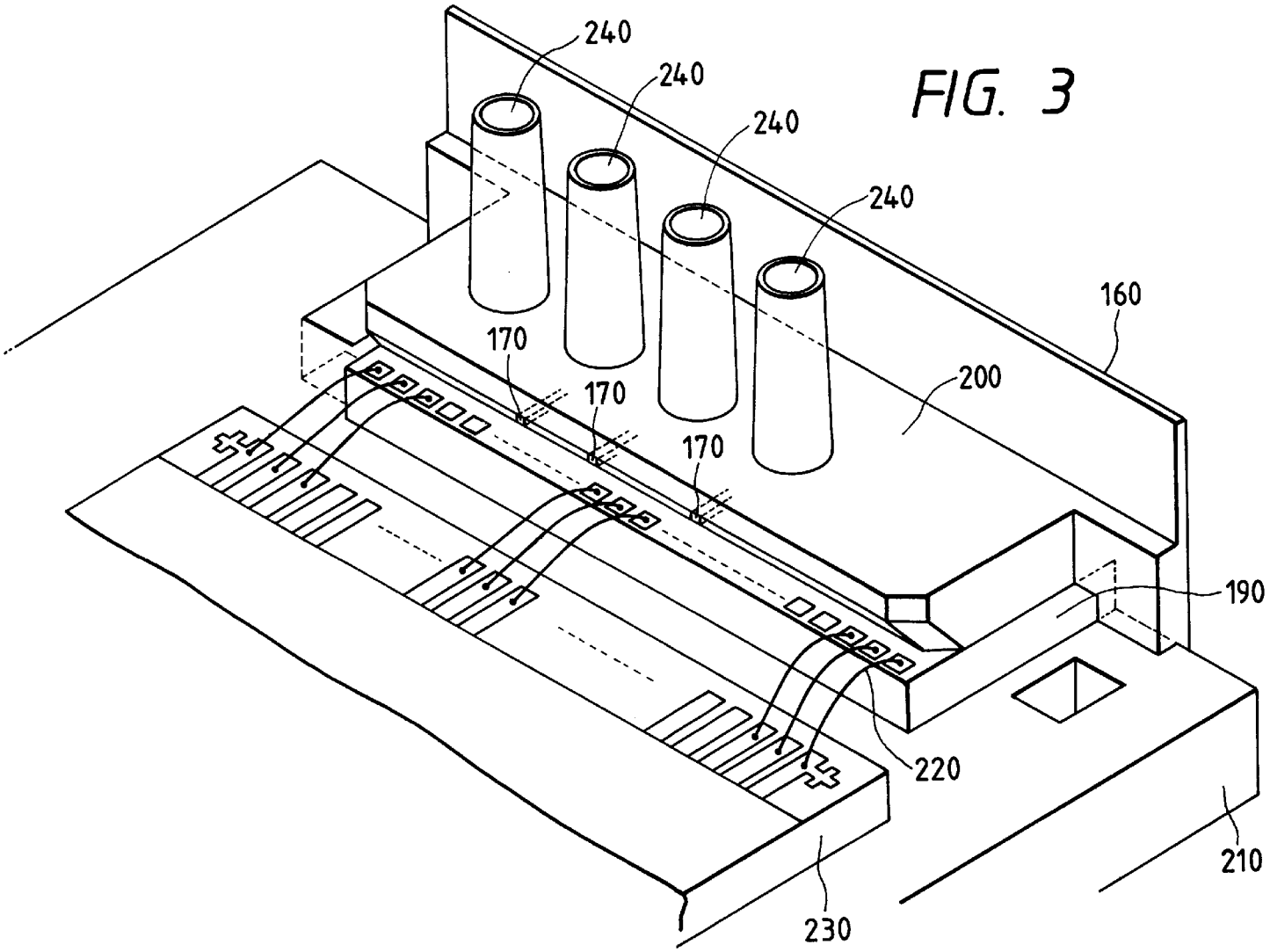
FIG. 3 is a perspective view which schematically illustrates the structure of an ink jet recording head in accordance with the present invention.

FIG. 1 is a perspective view which schematically illustrates the structure of the grooved ceiling plate of an ink jet recording head to be mounted on an ink jet recording apparatus in accordance with the present invention. FIG. 2 is an enlargement of a groove on the ceiling plate for filling in the sealing resin. FIG. 3 is a perspective view which schematically illustrates the structure of an ink jet recording head.

As shown in FIG. 3, the ink jet recording head comprises a grooved ceiling plate 200; a silicon substrate 190 provided with electrothermal transducing elements, having drivers incorporated in the substrate; an aluminum plate 210 on which the ceiling plate 200 and the silicon substrate 190 are connected and laminated; a printed circuit board 230 having the drivers being electrically connected to it by means of wiring 220; ink supply apertures 240 arranged to be extended from apertures formed on the ceiling plate; and an orifice plate 160 provided with common liquid chambers 180 formed by connecting the ceiling plate 200 and the silicon substrate 190, as well as a plurality of discharge ports (orifices) conductively connected with the nozzles 100. The ink jet recording head of the present embodiment is the one for use of color recording. As a result, four common liquid chambers 180 are formed on the ceiling plate in order to retain ink of different colors separately. Also, on the ceiling plate 200 the walls 150 are provided so as to separate the common liquid chambers 180, and the grooves 130 are formed so as to prevent ink in each of the common liquid chambers 180 from being mixed. The numeral 115 designates the walls of the dummy nozzles 110*a*.

The aluminum plate 210 is bonded to the silicon substrate 190 by use of an adhesive having a high heat conductivity for radiating heat from the silicon substrate 190.

In FIG. 2, a reference numeral 120 designates a hole open to the orifice plate 160, and also, conductively connected to the dummy nozzles 110. Also, the dummy nozzles 110 are conductively connected to the groove 130 for separating common liquid chambers, and comprises the comparatively wide first dummy nozzle 110*a* and the comparatively narrow second dummy nozzles 110*b* arranged adjacently to the first dummy nozzle 110*a*. The second dummy nozzles 110*b* are arranged at the same interval as the nozzles 100 for discharging ink. In accordance with the present embodiment, three second dummy nozzles 110*b* are arranged on each side of the first dummy nozzle 110*a*. Therefore, seven dummy nozzles 110 are arranged for each one of the separation grooves 130.

Now, as given below, the sealing resin is filled in each of the separation grooves 130 between the common liquid chambers 180. In other words, the sealing resin is filled in a dispenser, and then, by use of such dispenser, the sealing agent is coated on a part of the silicon substrate positioned in the vicinity of the sealing resin fill-in inlet 170 of the grooved ceiling plate 200. The sealing agent thus coated is caused to enter the separation groove 130 between the liquid chambers by means of capillary force. The sealing agent then reaches the dummy nozzle 110*a* in due course.

Figure 4A:
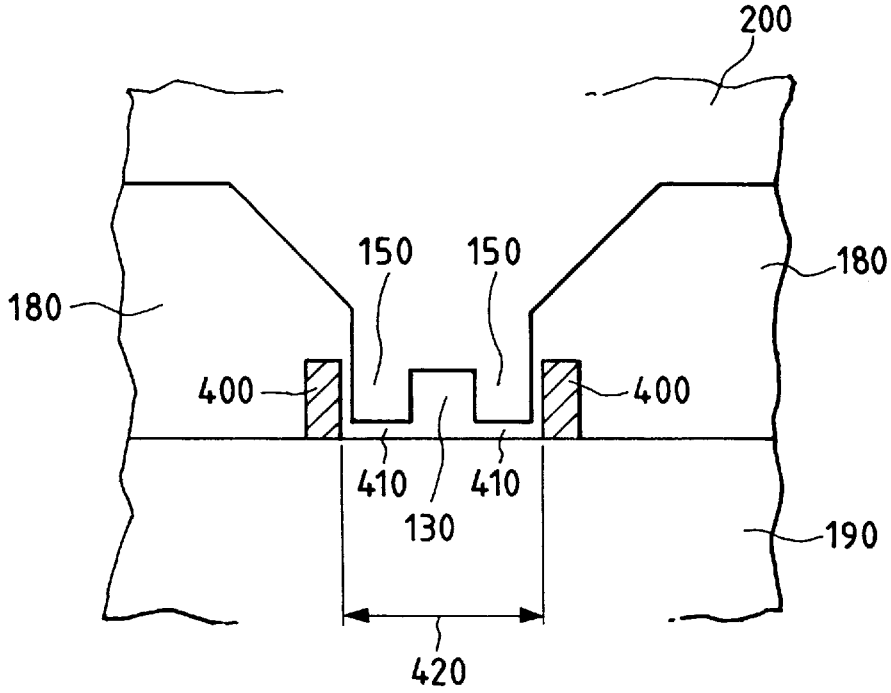
FIGS. 4A and 4B are views illustrating the structures of the ceiling plate and substrate applicable to the ink jet recording head in accordance with the present invention.

FIG. 4A is a cross-sectional view illustrating the structure of the groove 130 for separating the common chambers and the circumference of the separation wall 150 when the ceiling plate 200 and the silicon substrate 190 are connected.

The ceiling plate 200 is planted to stand so that it nips two separation walls 150 of the common liquid chambers that confine one separation groove 130 of the common liquid chambers, and also, there is provided the sealing resin antirunning member 400, which is higher than the gap formed between the ceiling plate 200 and the silicon substrate 190. Therefore, the sealing resin filled in from the sealing resin fill-in inlet 170 does not flow beyond the area 420 confined by the separation wall 150 and the antirunning member 400. Also, there is no possibility that the sealing resin flows into the common liquid chamber 180. Here, since the nozzle separation unit is structured in the same manner as the liquid chamber separation unit, it is possible to prevent the sealing resin from running into the discharge nozzles.

Figure 4B:
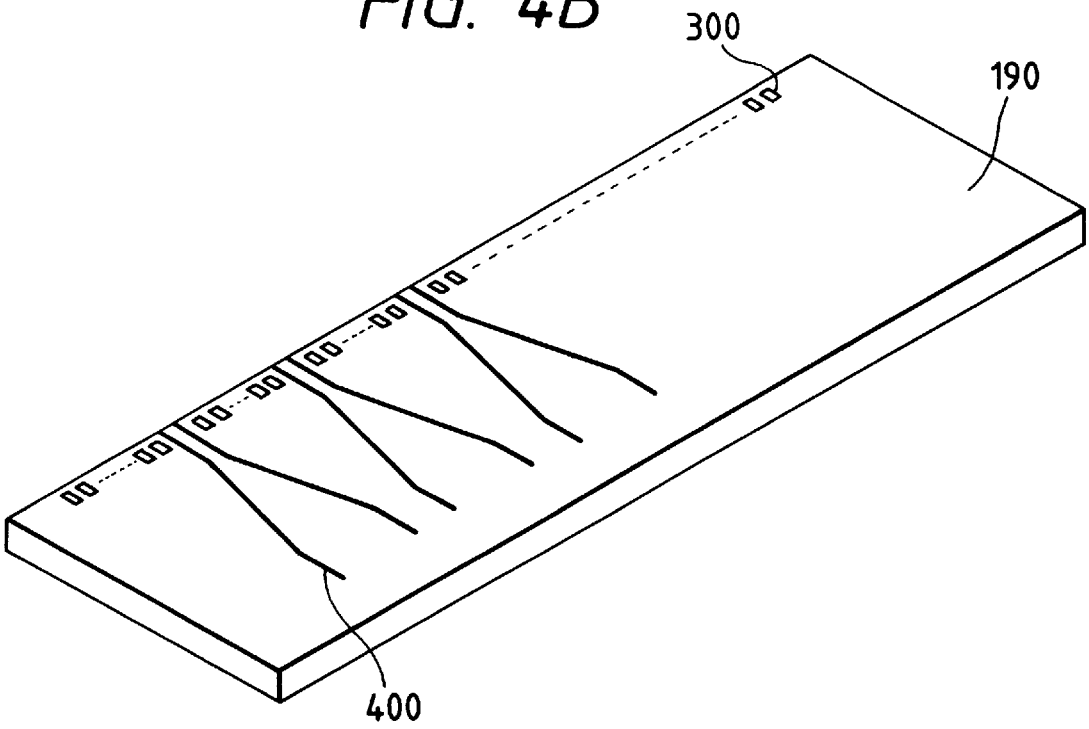

FIG. 4B is a view which shows one example in which the sealing resin antirunning members 400 are provided for the silicon substrate 190. If only the known photosensitive material (such as a dry film type resist or liquid resist) is applied, the members can be formed in good precision by means of the general process of photolithography. Also, patterning is possible on a non-photosensitive material by means of screen printing. Then, by hardening such patterned material, it may be possible to provide the antirunning members 400.

(Second Embodiment)

Figure 5:
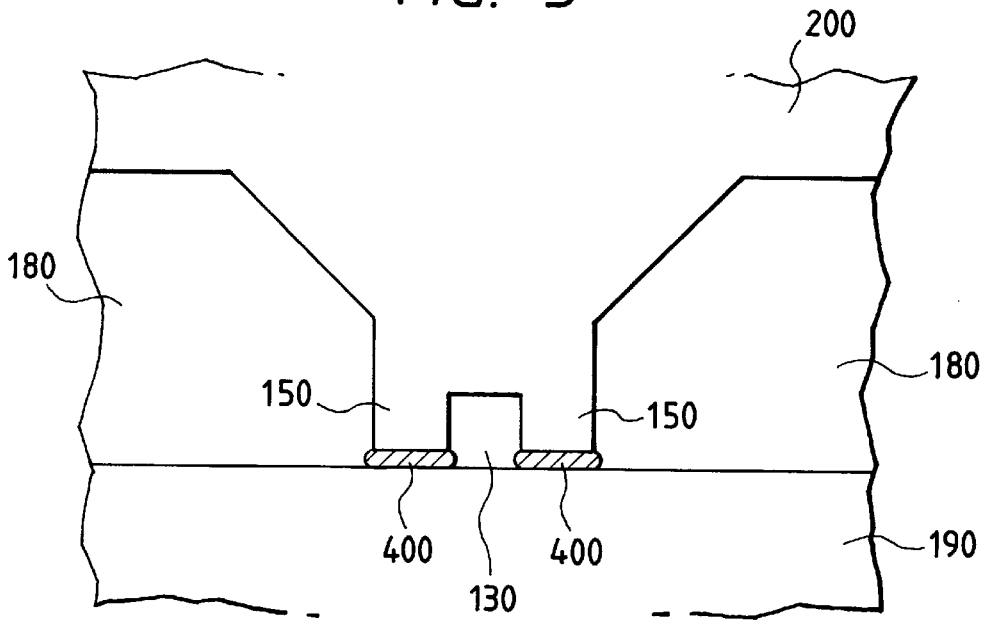
FIG. 5 is a cross-sectional view which shows the connecting portion between the ceiling plate and substrate applicable to the ink jet recording head in accordance with the present invention.

FIG. 5 is a cross-sectional view showing the part where the common liquid chambers are separated, which illustrates a second embodiment of the ink jet recording head in accordance with the present invention.

By means of the sealing resin antirunning members 400, it is possible to connect the side walls 150 of the common liquid chamber separation groove of the ceiling plate 200 with the silicon substrate 190 without any gap. Here, the material used for the members 400 should be deformed when the ceiling plate and the substrate are connected. Therefore, it is desirable to adopt an elastic material in this respect. For example, if the ceiling plate and the substrate are connected in a state that the photosensitive material is coated over the substrate 190 or over the ceiling plate 200, and then, the material is half hardened after the coating, an ink jet recording head of the present invention can be provided.

With the structure described above, it is possible to separate the liquid chambers, as well as the nozzles reliably without any excessive application of the sealing agent at all.

(Third Embodiment)

Figure 6A:
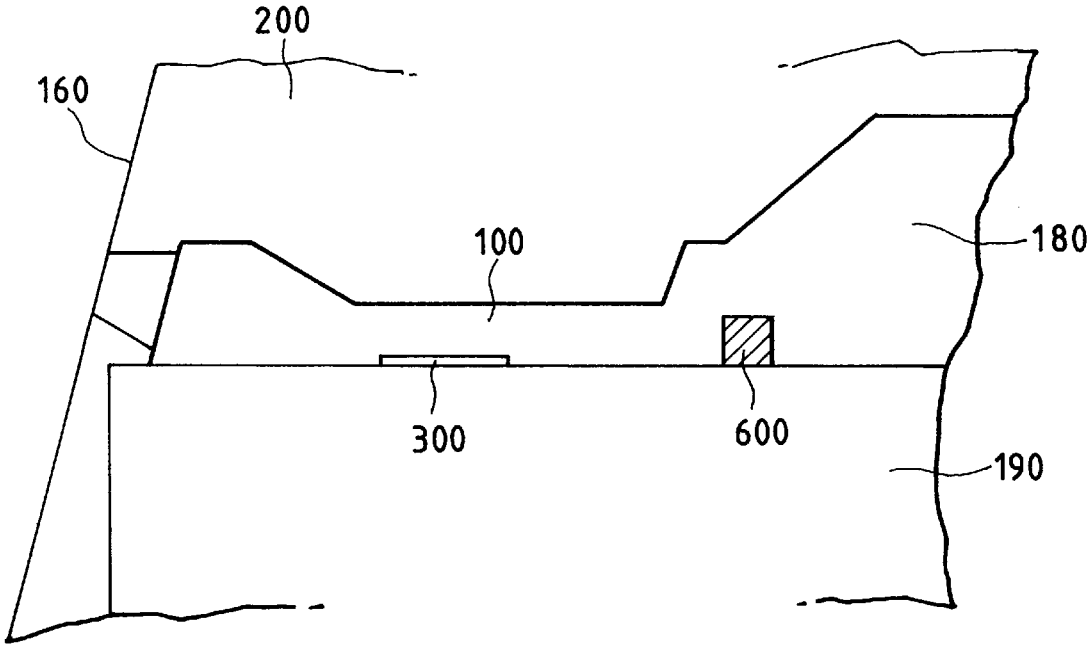
FIGS. 6A and 6B are views illustrating the structures of the ceiling plate and substrate applicable to the ink jet recording head in accordance with the present invention.
Figure 6B:
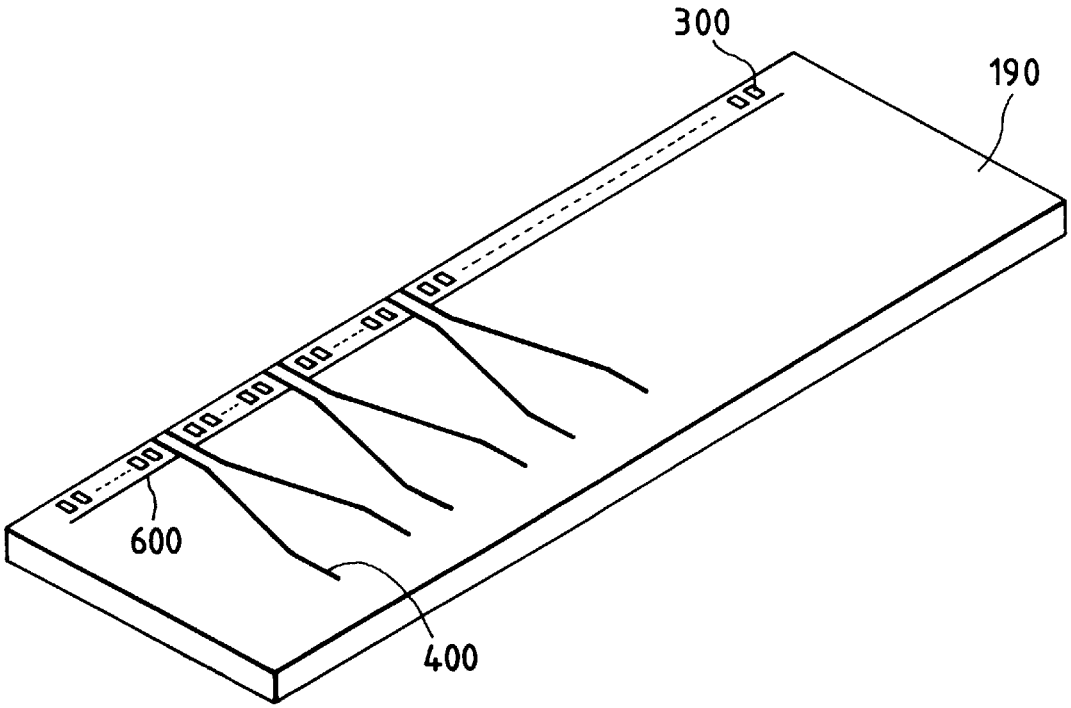

FIGS. 6A and 6B are views which shows a third embodiment of the present invention. FIG. 6A is a cross-sectional view showing the nozzle portion. A reference numeral 600 designate a fluid resistive member constituting a part of a nozzle, which functions to enhance the discharging efficiency by increasing the fluid resistance of the discharge energy generating elements 300 in the rear portion of the nozzles. The fluid resistive member 600 can be formed by the same material and in the same process as to provide the sealing resin antirunning member 400 as in the first embodiment. Therefore, there are no additional costs required for its manufacture. Also, it is possible to provide heads that can operate at higher speeds and efficiency than the conventional head that is provided with longer nozzles without any fluid resistive members arranged in it.

As has been described in the first to third embodiments, there is no overflow of sealing resin because of the provision of the sealing resin antirunning members both in the common liquid chambers and the portions to separate nozzles, hence making it possible to form ink jet recording heads capable of being manufactured in good yield. Also, it is confirmed that the contamination of discharge nozzles caused by the gas generated by the sealing resin, which is another problem encountered in the conventional art, is eliminated to a considerable extent.

Further, if required, the number of dummy nozzles can be reduced. The substrate can be made smaller accordingly. As a result, the number of the substrates that can be obtained from one wafer is increased, hence making it possible to reduce the costs of the substrate having various circuits formed on it. This component is most expensive among those required for the fabrication of an ink jet recording head.

Moreover, since the fluid resistive members can be formed at the same time of forming the sealing resin antirunning members, it is possible to provide highly efficient ink jet recording heads.

(Fourth Embodiment)

Figure 7:
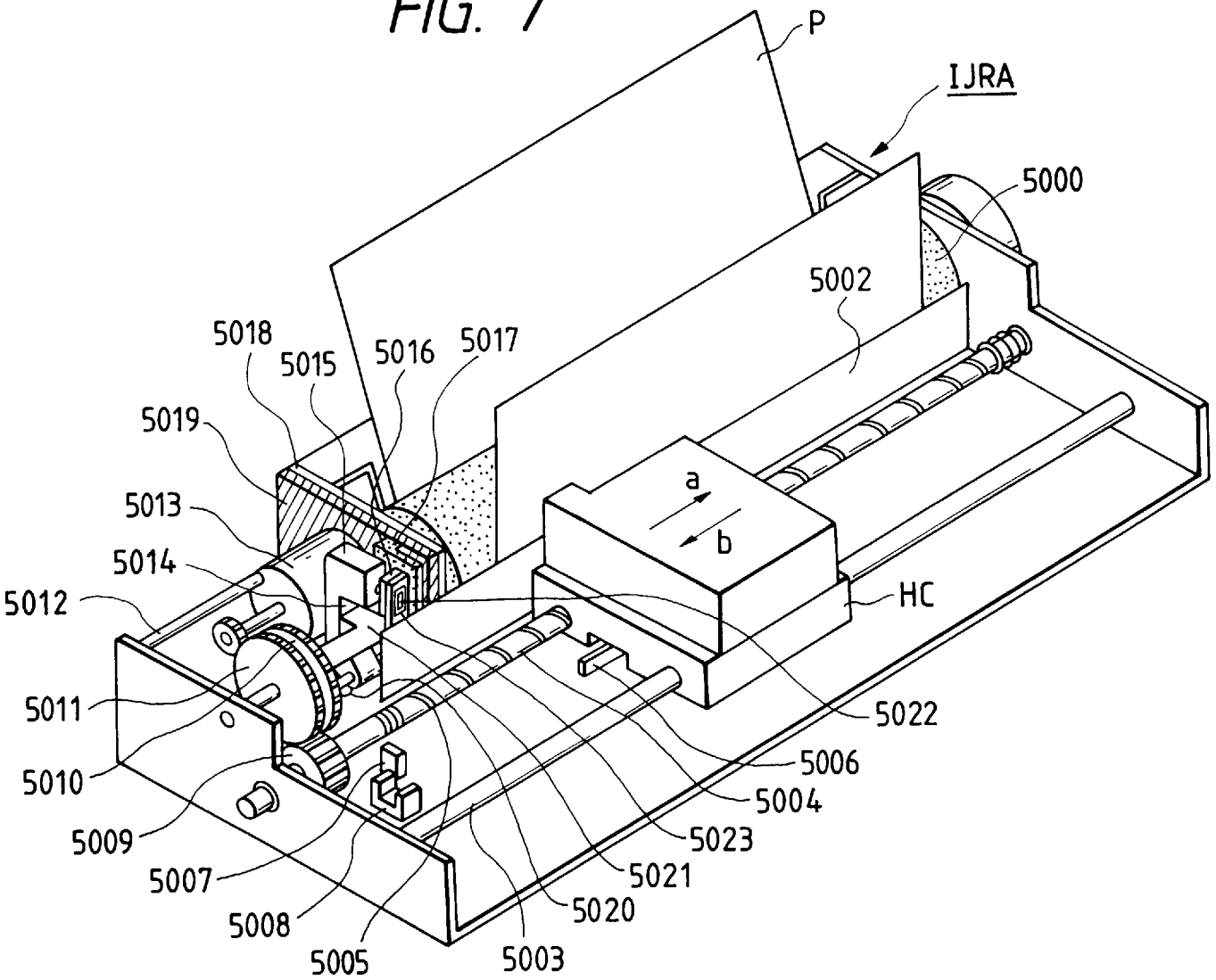
FIG. 7 is a perspective view which illustrates one example of an ink jet recording apparatus in accordance with the present invention.

FIG. 7 is a view which shows one example of an ink jet recording apparatus in accordance with the present invention. FIG. 7 is a view schematically illustrating an ink jet recording apparatus IJRA to which an integrated four-color ink jet cartridge of the present invention is applicable. Here, a carriage HC is provided with a pin (not shown) that engages with the spiral groove 5005 of a lead screw 5004. Interlocked with the regular and reverse rotations of a driving motor 5013, the lead screw rotates accordingly through the driving force transmission gears 5011 and 5009, thus enabling the carriage HC to reciprocate in the directions indicated by arrows a and b. On the carriage HC, a recording head unit 5025 and an ink tank unit 5062 are mounted. Here, a reference numeral 5002 designates a sheet pressure plate that presses the recording sheet to a platen 5000 in the traveling direction of carriage; 5007 and 5008, the photocoupler that serves as means for detecting home position by sensing the presence of the carriage lever 5006 in this area, hence switching over the rotational directions of the motor 5013; 5016, a supporting member to support a capping member 5022 that caps the front face of the recording head; 5015, suction means for sucking the interior of the cap to perform the suction recovery of the recording head through the aperture 5023 arranged in the cap. Also, a reference numeral 5017 designates a cleaning blade; 5019, a member that enables the blade to move forward and backward, which is supported by the main body supporting plate 5018; 5012, a lever used for starting suction for the suction recovery, which can shift along the movement of the cam 5020 that engages with the carriage, in order to control the motion of the driving force from a driving motor by known transmission means, such as the change over of a clutch.

These capping, cleaning, and suction recovery are arranged to be executed as desired in the respective locations by the function of the lead screw 5005 when the carriage HC is positioned in the area on its home position side. However, if only the desired operations are executed by the application of known timing, it is possible to apply any one of them to the present embodiment.

(Other Embodiments)

Of the ink jet recording apparatuses, the present invention demonstrates particularly excellent effects when it is applied to a recording head and recording apparatus of a type that creates change of states of ink by the application of thermal energy with the provision of means (electrothermal transducing elements, laser beam, or the like, for example) for generating thermal energy as energy to be utilized for executing ink discharges. With a method of the kind, it is possible to attain a highly densified recording in high precision.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducing element disposed on a liquid (ink) retaining sheet or liquid passage whereby to cause the electrothermal transducing element to generate thermal energy to produce film boiling on the thermoactive portion of recording means (recording head), thus effectively leading to the resultant formation of a bubble in the recording liquid (ink) one to one in response to each of the driving signals. By the development and contraction of the bubble, the liquid (ink) is discharged through a discharge port to produce at least one droplet. The driving signal is more preferably in the form of pulses because the development and contraction of the bubble can be effectuated instantaneously, and, therefore, the liquid (ink) is discharged with quicker response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducing elements (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharge ports. In other words, in accordance with the present invention, it is possible to perform recording reliably and efficiently irrespective of the modes of recording head.

Further, the present invention is effectively applicable to a recording head of full-line type having a length corresponding to the maximum width of a recording medium recordable by the recording apparatus. For such recording head, it may be possible to adopt either a structure whereby to satisfy the required length by combining a plurality of recording heads or a structure arranged by one recording head integrally formed.

In addition, the present invention is effectively applicable to a recording apparatus of serial type exemplified above, irrespective of whether using the recording head fixed to the apparatus main body; the recording head of an exchangeable chip type, which can be electrically connected with the apparatus main body or to which ink can be supplied from the apparatus main body when it is installed in the apparatus main body, or using the recording head of a cartridge type in which an ink tank is formed integrally with the recording head itself.

Also, for the present invention, it is preferable to additionally provide a recording head with recovery means and preliminarily auxiliary means as constituents of the recording apparatus because these additional means will contribute to enabling the effectiveness of the present invention to be more stabilized. To name them specifically, these are capping means for the recording head, cleaning means, suction recovery means, recovery means by use of compression, preheating means such as electrothermal transducing elements or heating elements other than such transducing elements or the combination of those types of elements, and a predischarge means for performing discharge other than the regular discharge.

Also, for the kinds and numbers of mounted recording heads, it is possible to provide a plurality of heads for plural kinds of ink having different colors or densities besides a single head applicable to only a monochromatic ink. In other words, the present invention is extremely effective in applying them not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

Moreover, in the embodiments of the present invention described above, while the ink has been described as liquid, it may be an ink material which is solidified below the room temperature but liquefied at the room temperature. Since the ink is generally controlled within the temperature not lower than 30° C. and not higher than 70° C. to stabilize its viscosity for the provision of the stable discharge, the ink may be such as to be liquefied when the applicable recording signals are given. In addition, while positively preventing the temperature from rising due to the thermal energy by use of such energy as an energy to be consumed for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain ink in the form of liquid or solid in the recesses or through holes of a porous sheet such as disclosed in Japanese Patent Laid-Open Application No. 54-56847 or 60-71260 in order to enable the ink to face the electrothermal transducers. In the present invention, the most effective method for the various kinds of ink mentioned above is the one capable of implementing the film boiling method as described above.

Further, as the mode of the recording apparatus in accordance with the present invention, it may be possible to adopt a copying apparatus combined with a reader in addition to the image output terminal for a computer, or other information processing apparatus, and also, it may be possible to adopt a mode of a facsimile equipment having transmitting and receiving functions.

As has been described above, in accordance with the present invention, an ink jet recording head, an ink jet recording apparatus having such recording head mounted on it, and information processing systems having such apparatus as its output means comprise a ceiling plate provided with the separation wall portions that separate the adjacent common liquid chambers and the sealing material fill-in grooves formed on such separation wall portions, and a substrate provided with the sealing material antirunning members planted to stand for nipping the separation wall portions and in closely contact with them. Further, the recording head is characterized in that the sealing material is filled in the sealing material fill-in grooves. With the structure thus arranged, it is possible to manufacture the recording heads in good yield, while easily attaining the separation of the common liquid chambers reliably.

What is claimed is:

1. An ink jet recording head comprising:

a ceiling plate provided with a plurality of grooves defining a plurality of ink paths, each said ink path including a nozzle, a plurality of extrusions confining said grooves, a plurality of recesses defining a plurality of common liquid chambers conductively connected with said grooves, a plurality of supply apertures for supplying an ink to said common liquid chambers, a plurality of separation walls to separate adjacent said common liquid chambers, and a plurality of sealing material fill-in grooves formed on said separation walls; and an elemental substrate having a plurality of energy generating elements formed thereon to generate energy to discharge the ink, said elemental substrate having a plurality of sealing material antirunning members for preventing a sealing material from flowing into each of said liquid chambers through any of a plurality of gaps which exist between said separation walls and said elemental substrate, wherein said ink jet recording head is formed by connecting said ceiling plate and said elemental substrate, and said sealing material is filled in said sealing material fill-in grooves.

2. A recording head according to claim 1, wherein said sealing material antirunning members are higher than said gaps between said ceiling plate and said separation walls which exist when said ceiling plate and said substrate are connected.

3. A recording head according to claim 1 or claim 2, wherein said sealing material antirunning members are arranged along said grooves defining said common liquid chambers and said grooves defining the nozzles conductively connected with said common liquid chambers.

4. A recording head according to either one of claims 1 or 2, wherein said sealing resin fill-in grooves are arranged along said grooves defining said common liquid chambers and said grooves defining the nozzles conductively connected with said common liquid chambers, and said sealing resin fill-in grooves are provided with a plurality of dummy nozzles adjacent to said nozzles.

5. A recording head according to claim 4, wherein said dummy nozzles are arranged with a same interval and a same height as said nozzles.

6. A recording head according to either one of claims 1 or 2, further comprising:

a plurality of fluid resistive members disposed within said ink paths downstream of said energy transducing elements.

7. A recording head according to claim 6, wherein said fluid resistive members are formed by the sealing material that forms said sealing material antirunning members.

8. A recording head according to either one of claims 1 or 2, wherein said sealing material antirunning members are formed from an elastic material.

9. A recording head according to either one of claims 1 or 2, wherein said recording head performs color recording, and each of said common liquid chambers uses a different color ink.

10. A recording head according to either one of claims 1 or 2, wherein said recording head is a recording head of a full line type.

11. A recording head according to either one of claims 1 or 2, wherein said energy transducing elements are electrothermal transducing elements for creating film boiling in the ink.

12. An ink jet recording apparatus comprising:

an ink jet recording head mounted thereon as a recording means for recording images, comprising;

a ceiling plate provided with plurality of grooves defining a plurality of ink paths, each said ink path including a nozzle, a plurality of extrusions confining said grooves, a plurality of recesses defining a plurality of common liquid chambers conductively connected with said grooves, a plurality of supply apertures for supplying an ink to said common liquid chambers, a plurality of separation walls to separate adjacent said common liquid chambers, and a plurality of sealing material fill-in grooves formed on said separation walls; and an elemental substrate having a plurality of energy generating elements formed thereon to generate energy to discharge the ink, said elemental substrate having a plurality of sealing material antirunning members for Preventing a sealing material from flowing into each of said liquid chambers through any of a plurality of gaps which exist between said separation walls and said elemental substrate, wherein said ink jet recording head is formed by connecting said ceiling plate and said elemental substrate, and said sealing material is filled in said sealing material fill-in grooves.

13. An information processing system comprising:

an ink jet recording apparatus as an output means for outputting an image, said ink jet recording apparatus including;

an ink recording head mounted thereon for recording images, comprising;

a ceiling plate provided with a plurality of grooves defining a plurality of ink paths, each said ink path including a nozzle, a plurality of extrusions confining said grooves, a plurality of recesses defining a plurality of common liquid chambers conductively connected with said grooves, a plurality of supply apertures for supplying an ink to said common liquid chambers, a plurality of separation walls to separate adjacent said common liquid chambers, and a plurality of sealing material fill-in grooves formed on said separation walls; and an elemental substrate having a plurality of energy generating elements formed thereon to generate energy to discharge the ink, said elemental substrate having a plurality of sealing material antirunning members for preventing a sealing material from flowing into each of said liquid chambers through any of a plurality of gaps which exist between said separation walls and said elemental substrate, wherein said ink jet recording head is formed by connecting said ceiling plate and said elemental substrate, and said sealing material is filled in said sealing material fill-in grooves.

14. An ink jet recording apparatus comprising:

an ink jet recording head mounted thereon as a recording means for recording images, comprising;

a ceiling plate provided with a plurality of grooves defining a plurality of ink paths, each said ink path including a nozzle, a plurality of extrusions confining said grooves, a plurality of recesses defining a plurality of common liquid chambers conductively connected with said grooves, a plurality of supply apertures for supplying an ink to said common liquid chambers, a plurality of separation walls to separate adjacent said common liquid chambers, and a plurality of sealing material fill-in grooves formed on said separation walls; and an elemental substrate having a plurality of energy generating elements formed thereon to generate energy to discharge the ink, said elemental substrate having a plurality of sealing material antirunning members for preventing a sealing material from flowing into each of said liquid chambers through any of a plurality of gaps which exist between said separation walls and said elemental substrate, wherein said ink jet recording head is formed by connecting said ceiling plate and said elemental substrate, and said sealing material is filled in said sealing material fill-in grooves, and wherein said sealing material antirunning members are higher than said gaps between said ceiling plate and said separation walls which exist when said ceiling plate and said substrate are connected.

15. An information processing system comprising:

an ink jet recording apparatus as an output means for outputting an image, said ink jet recording apparatus including;

an ink recording head mounted thereon for recording images, comprising;

a ceiling plate provided with a plurality of grooves defining a plurality of ink paths, each said ink path including a nozzle, a plurality of extrusions confining said grooves, a plurality of recesses defining a plurality of common liquid chambers conductively connected with said grooves, a plurality of supply apertures for supplying an ink to said common liquid chambers, a plurality of separation walls to separate adjacent said common liquid chambers, and a plurality of sealing material fill-in grooves formed on said separation walls; and an elemental substrate having a plurality of energy generating elements formed thereon to generate energy to discharge the ink, said elemental substrate having a plurality of sealing material antirunning members for preventing a sealing material from flowing into each of said liquid chambers through any of a plurality of gaps which exist between said separation walls and said elemental substrate, wherein said ink jet recording head is formed by connecting said ceiling plate and said elemental substrate, and said sealing material is filled in said sealing material fill-in grooves, and said sealing material antirunning members are higher than said gaps between said ceiling plate and said separation walls which exist when said ceiling plate and said substrate are connected.

* * * * *

UNITED STATES PATENT AND TRADEMARK OFFICE

CERTIFICATE OF CORRECTION

PATENT NO. : 6,000,777

DATED : December 14, 1999

INVENTOR(S) : MINORU NOZAWA ET AL.

It is certified that error appears in the above-identified patent and that said Letters Patent is hereby corrected as shown below:

ON THE COVER PAGE:

Under Column [56], in References Cited, under Foreign Patent Documents:

"59-138461 1/1983" should read --59-138461 8/1984--.

IN THE DRAWINGS:

In Sheet 4, Figure 4A:

Figure 4A should be replaced with the attached drawing.

Figure 8:
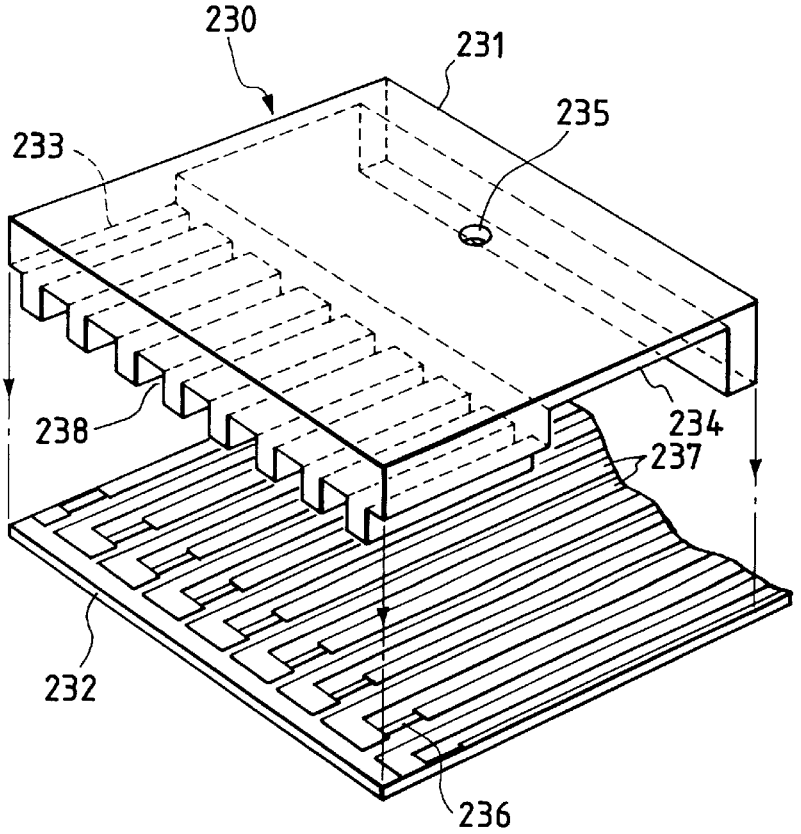
FIG. 8 is a perspective view which illustrates the structure of an ink jet recording head applicable to the conventional ink jet recording apparatus.

In Sheet 5, Figure 8:

Figure 8 should be replaced with the attached drawing.

Figure 9:
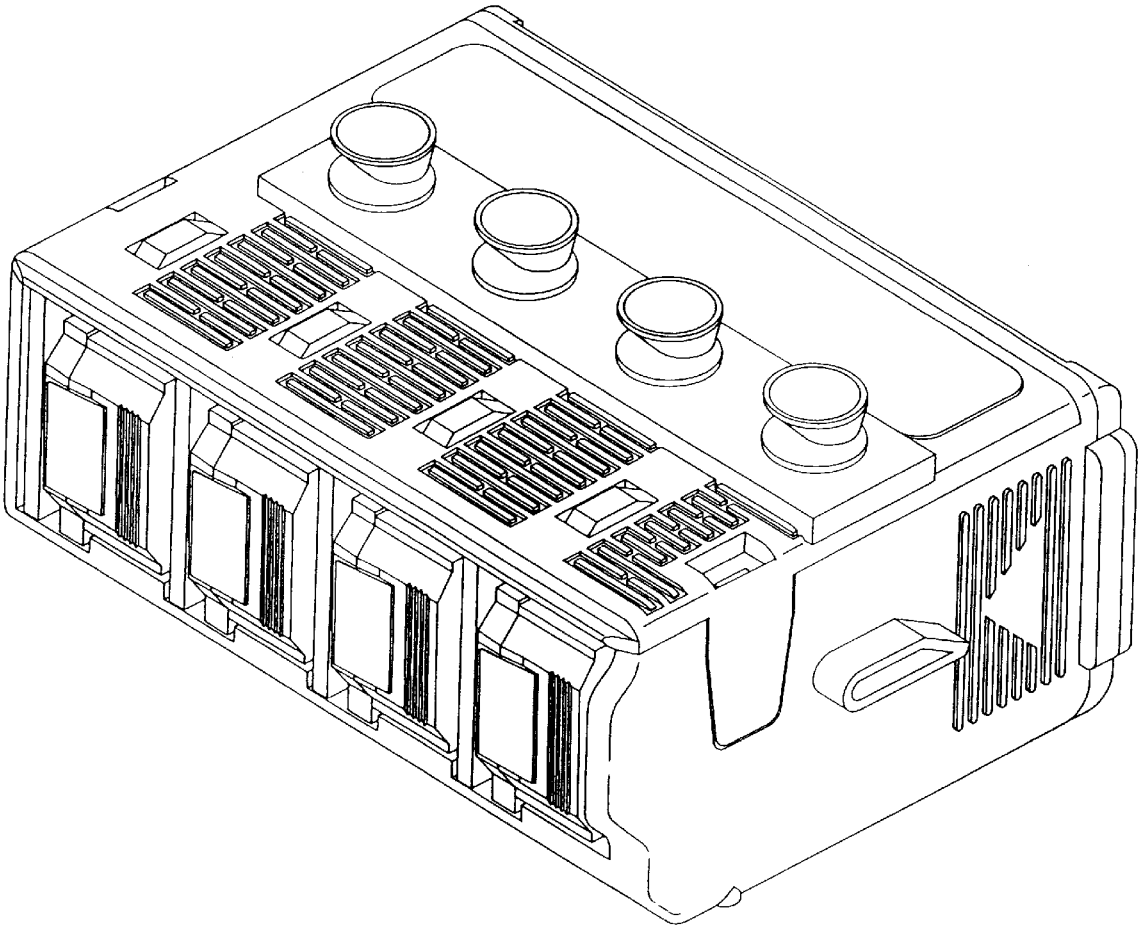
FIG. 9 is a perspective view which illustrates an ink jet unit applicable to the conventional ink jet recording apparatus.
Figure 4A:
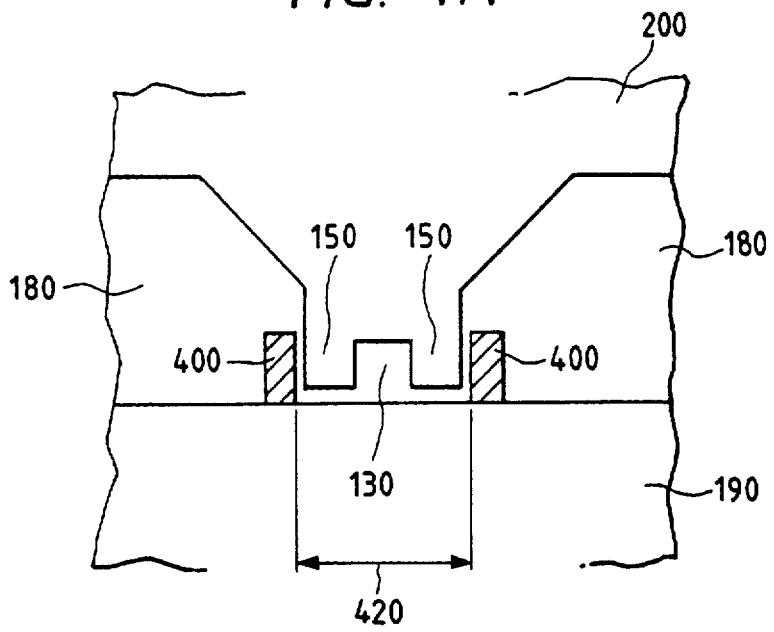
Figure 4B:
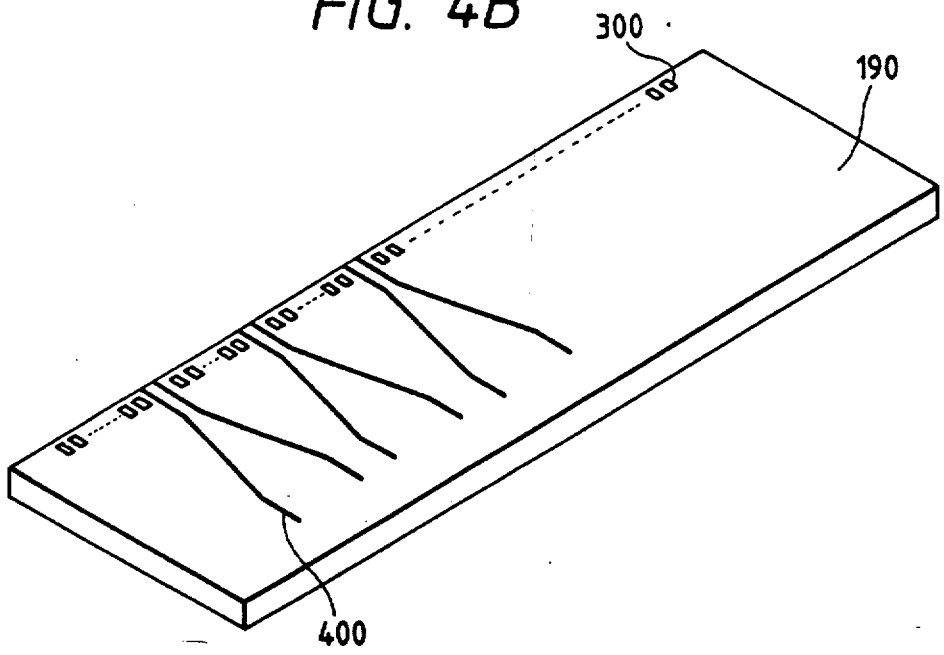
Figure 5:
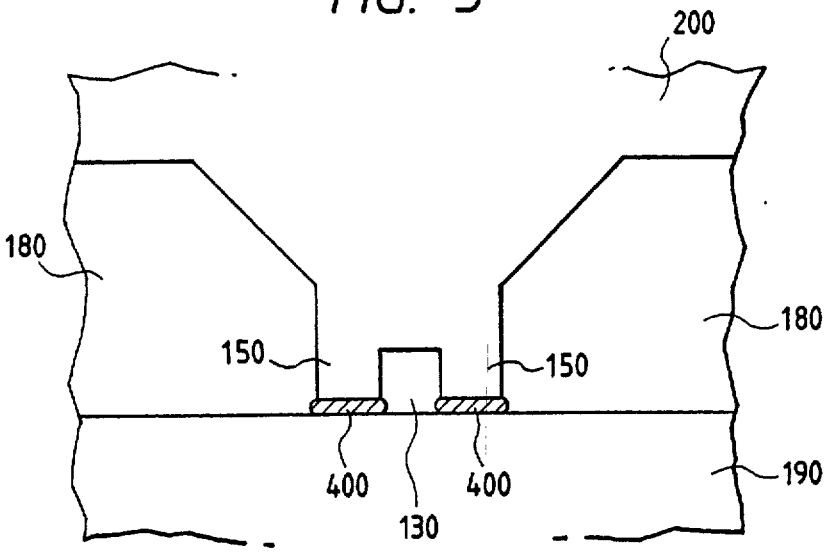
Figure 8:
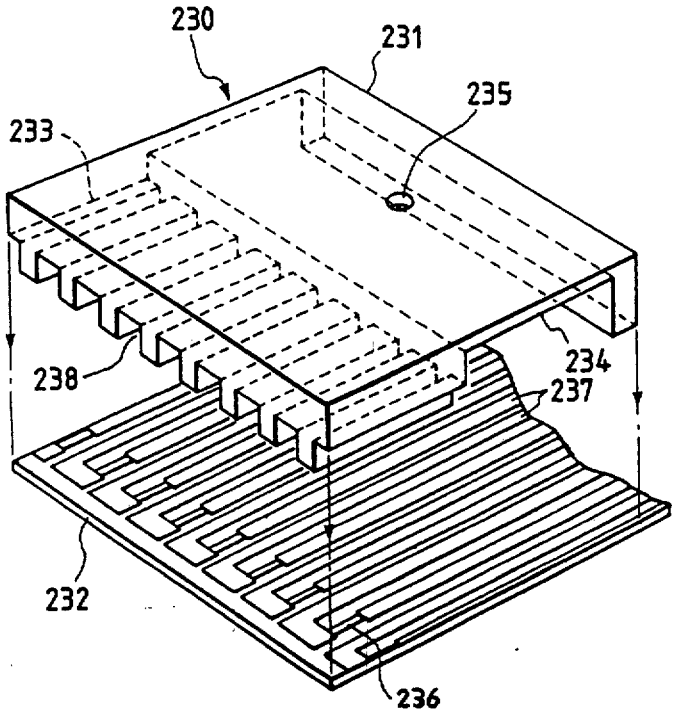
FIG. 8 PRIOR ART
Figure 9:
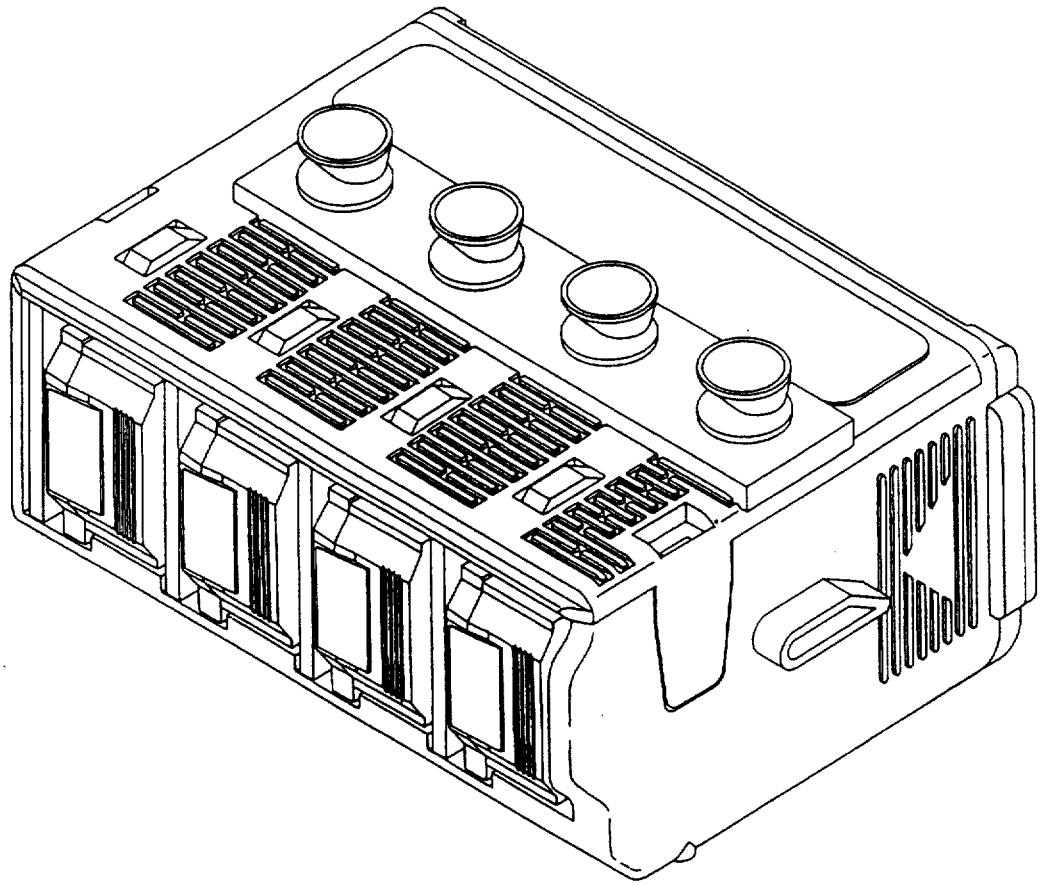
FIG. 9 PRIOR ART

In Sheet 8, Figure 9:

Figure 9 should be replaced with the attached drawing.

COLUMN 1

Line 65, "on the" should read --in--.

COLUMN 2

Line 55, "For that matter," should be deleted.

UNITED STATES PATENT AND TRADEMARK OFFICE

CERTIFICATE OF CORRECTION

PATENT NO. : 6,000,777

DATED : December 14, 1999

INVENTOR(S) : MINORU NOZAWA ET AL.

It is certified that error appears in the above-identified patent and that said Letters Patent is hereby corrected as shown below:

COLUMN 6

Line 46, "designate" should read --designates--.

COLUMN 10

Line 1, "closely" should read --close--.

COLUMN 11

Line 23, "Preventing" should read --preventing--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*